US005298941A

United States Patent [19]

Tenpaku

[11] Patent Number: 5,298,941

[45] Date of Patent: Mar. 29, 1994

[54] IMAGE FORMING APPARATUS HAVING GROUNDED METAL PLATE SUPPORTING DRIVE TRANSMITTING MEMBERS AND SEPARATING ELECTRICAL EQUIPMENT UNITS

[75] Inventor: Chitose Tenpaku, Kawasaki, Japan

[73] Assignee: Canon Kabushiki Kaisha, Tokyo, Japan

[21] Appl. No.: 912,263

[22] Filed: Jul. 13, 1992

[30] Foreign Application Priority Data

Jul. 15, 1991 [JP] Japan ..... 3-200091

[51] Int. Cl.[5] ..... G03G 15/00

[52] U.S. Cl. ..... 355/200; 346/160.1; 174/51

[58] Field of Search ..... 355/200, 210; 346/76 L, 346/108, 160, 160.1; 358/296, 300, 302; 174/5 SG, 6, 7, 51

[56] References Cited

U.S. PATENT DOCUMENTS 3,985,436 10/1976 Tanaka et al. ..... 355/200
4,563,078 1/1986 Fantuzzo et al. ..... 355/200
4,931,834 6/1990 Suga ..... 355/200
4,985,731 1/1991 Sakakura et al. ..... 355/200 X
4,989,037 1/1991 Nagatsuna ..... 355/200

FOREIGN PATENT DOCUMENTS 0018679 2/1980 Japan .
0247652 12/1985 Japan ..... 355/200
1-00566 4/1989 Japan ..... 355/200
0090455 4/1989 Japan ..... 355/200

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming apparatus includes an image forming device for forming an image on to a recording material and a driving source for driving the image formation device. A plurality of drive force transmitting members transmit a drive force from the driving source to the image forming device and a plurality of electrical equipment units, mounted on a substrate, control the image forming device. A grounded metal plate which supports the plurality of driving force transmitting members is interposed between at least two of the plurality of electrical equipment units.

6 Claims, 5 Drawing Sheets

IMAGE FORMING APPARATUS HAVING GROUNDED METAL PLATE SUPPORTING DRIVE TRANSMITTING MEMBERS AND SEPARATING ELECTRICAL EQUIPMENT UNITS

BACKGROUND OF THE INVENTION

1. Field of the Invention

The present invention relates to an apparatus for forming a developed image onto a recording material of a device, such as a copying machine or printer.

2. Description of the Related Art

Various electrical equipment units must be used in order to drive image forming apparatuses. For example, typical electrical units are: an engine unit for controlling components such as a power supply, a paper feed unit, a scanner and a fixing unit, and an image controller for converting image codes transmitted from a host computer into dot images. The image controller is composed of highly integrated components, such as a microprocessor. Accordingly, in many cases, multilayered and double-sided substrates are employed to make effective use of space and reduce radiation noise. The engine unit is composed of large and heavy components, such as the power supply and a transformer. The degree of integration of these components is lower than that of the components of the image controller. Therefore, single-sided substrates are employed for the engine unit. The cost of single-sided substrates is lower than that of multilayered and double-sided substrates. The single-sided substrates are sufficient for use in the engine unit.

For these reasons, it is preferable that the engine unit and image controller be separately attached to an image forming apparatus. It is also preferable that the engine unit be covered with "grounded sheet metal" because the engine unit produces relatively high magnitude radiation noise.

Nonetheless, radiation noise is transmitted to the image controller through a connector which connects the engine unit to the image controller and then it is transmitted from the image controller to the outside. The image controller, like the engine unit, may be covered with "grounded sheet metal". However, it is not desirable to cover the image controller with "grounded sheet metal", since to do so would increase the cost of the image forming apparatus and make it difficult to replace one image controller with another one in accordance with the type of external computer being used.

Thus, the radiation noise transmitted from the image controller causes a problem.

In conventional image forming apparatuses a paper feed roller, a carrier roller, image forming means, such as a photosensitive drum, a developing roller and a charge roller, and other components are operated by force from a driving source through driving force transmitting device. A plurality of drive gears are usually used as the driving force transmitting device. As shown in FIG. 3, the drive gears are arranged on both sides of the image forming apparatus, as viewed from the direction indicated by arrow A. These gears are rotatably supported by a plurality of supporting members, and thus they occupy large portions within the apparatus.

Accordingly, the foregoing conventional image forming apparatus suffers from the above-described problems of radiation noise transmitted from the image controller and bulky arrangement of the drive gears.

SUMMARY OF THE INVENTION

The present invention provides an image forming apparatus in which noise radiation is diminished by providing grounded sheet metal interposed between first and second electrical equipment units.

The present invention also provides an image forming apparatus in which the bulky arrangement of drive gears is reduced by using the grounded sheet metal as a support for the drive gears of the driving force.

According to one aspect of the invention, an image forming apparatus includes an image forming means for forming an image onto a recording material, and an electrical equipment unit for controlling the image forming means. The electrical equipment unit comprises a first electrical equipment unit and a second electrical equipment unit. Sheet meal is interposed between the first and second electrical equipment units. The sheet metal is grounded and provides support for a plurality of driving force transmitting members for driving the image forming means.

Objectives and advantages in addition to those discussed above shall be apparent to those skilled in the art from the description of the preferred embodiment of the invention which follows. In the description, reference is made to the accompanying drawings, which form a part hereof, and which illustrate an example of the invention. Such example, however, is not exhaustive of the various embodiments of the invention, and therefore reference is made to the appended claims for determining the scope of the invention.

DESCRIPTION OF THE PREFERRED EMBODIMENTS

An image forming apparatus of the present invention will be described as applied to a laser beam printer shown in FIGS. 1, 2, 4 and 5 as an example. For the purpose of facilitating the description of the present invention, a charger, an image carrier, exposing means, developing means, transferring means, cleaning means, means for carrying a recording member, etc., all of which are related to forming images, are collectively referred to as image forming means.

Figure 4:
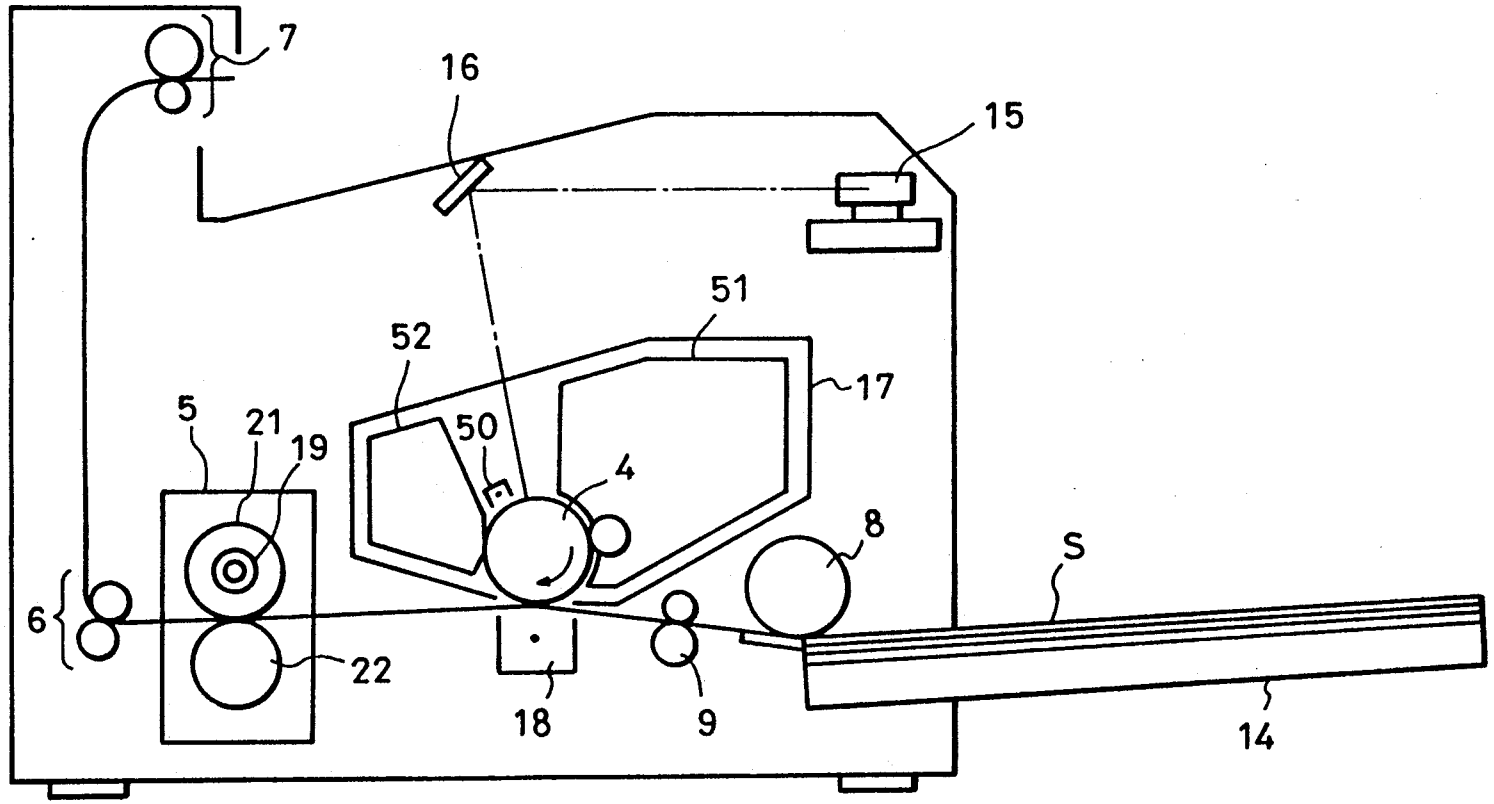
FIG. 4 is a sectional view showing the image forming apparatus of the present invention.

As shown in FIG. 4, a paper feed roller 8 separates a top recording material S in a cassette 14 from other recording materials in order to feed the recording material S. A paper feed motor 11 transmits a rotative driving force to the paper feed roller 8. The paper feed roller 8 is driven intermittently by solenoid actuator 12 and a spring clutch (not shown), coaxial with the roller 8, so as to feed the recording material S until it contacts a resist roller 9. The resist roller 9 is used for controlling the timing at which the lead edge of the recording material S is fed. In the same manner as the paper feed roller 8, the resist roller 9 is driven intermittently by a solenoid actuator 13 and a spring clutch (not shown), coaxial with the roller 9, so as to feed the recording material S to a photosensitive drum 4.

Light is emitted from a laser oscillator (not shown) in accordance with image information, reflected from a rotatable polygon mirror 15 and then again reflected from mirror 16 onto the photosensitive drum 4. In this way, the photosensitive drum 4, having been charged uniformly by a primary charger 50, is exposed to the light so that a latent image is formed. The photosensitive drum 4 is incorporated into a process cartridge 17. In addition to the photosensitive drum 4, the primary charger 50, a developing machine 51, a device 52 for cleaning the photosensitive drum 4 are also incorporated into the process cartridge 17. The latent image on the photosensitive drum 4 is formed into a visible image by the developing machine 51, transferred first onto the recording material S by a transfer charger 18, and then transferred to fixing device 5, where it is fixed.

The fixing device 5 is made up of a rubber pressure roller 22 and an aluminum fixing roller 21 having a built-in halogen heater 19. The image on the recording material S is melted and fixed by heat and pressure applied from the fixing and pressure rollers 21 and 22. The recording material S passes through fixing device 5, carrier rollers 6 and paper discharge roller 7, and is then discharged. Cleaning device 52 removes residual toner on the photosensitive drum 4, which is not transferred to the recording material S.

Figure 1:
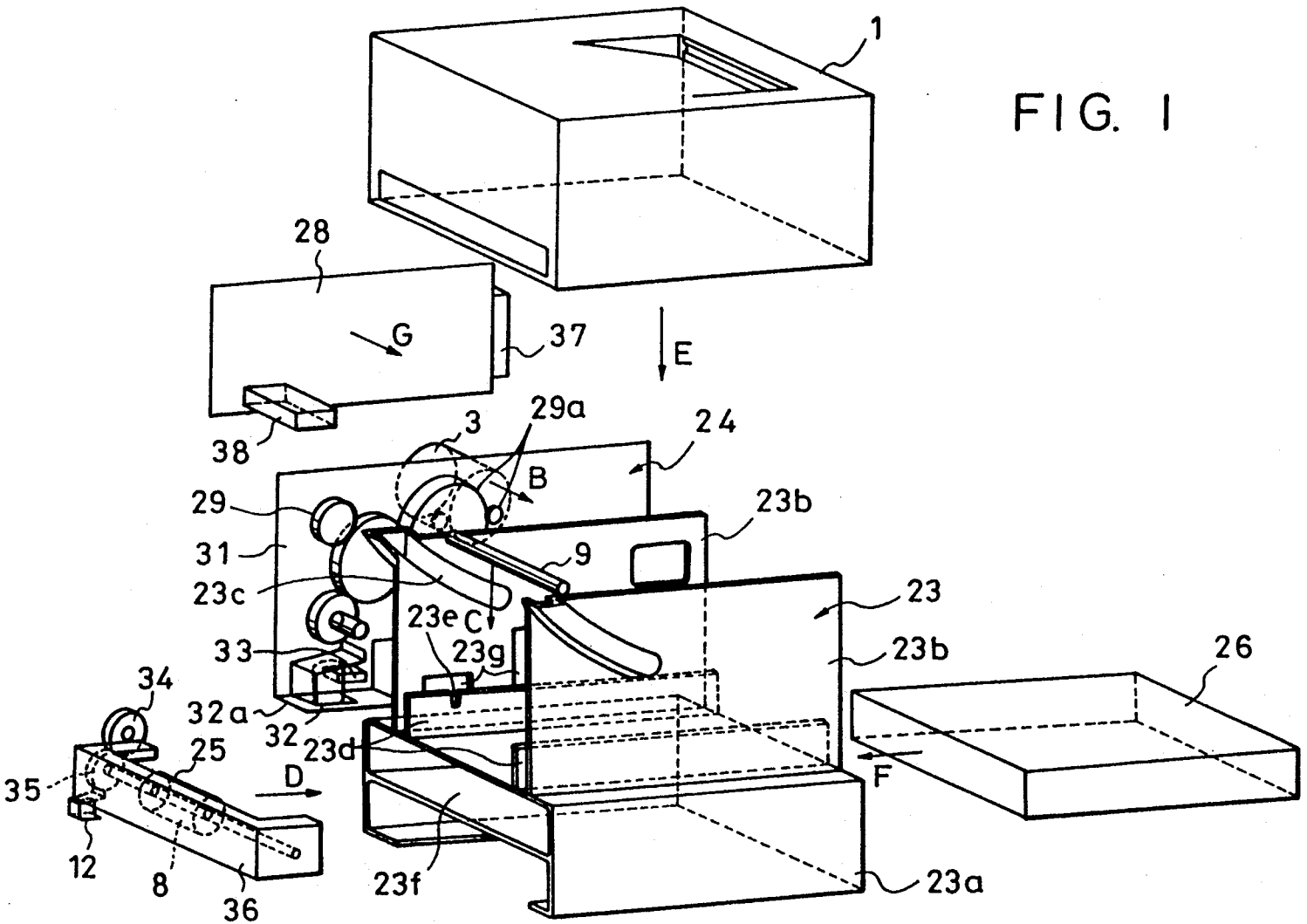
FIG. 1 is an exploded perspective view showing a first embodiment of an image forming apparatus in accordance with the present invention.

A first embodiment of the present invention will now be described with reference to FIG. 1, which is an exploded perspective view showing the image forming apparatus of the present invention. Frame 31 of a drive unit made of galvanized sheet metal, on which a plurality of drive gears are supported, resist roller 9, paper feed unit 25, external frame 1, first electrical equipment unit 26, which is an engine unit, and second electrical equipment unit 28, which is an image controller, are all attached to frame 23, which is the framework of the image forming apparatus, are placed together in the directions indicated by B, C, D, E, F and G, respectively, to form the image forming apparatus of the present invention.

The frame 23 is monolithically molded. Two parallel side plates 23*b* extend from stand 23*a*. Guide groove 23*c* is formed in each side plate 23*b*. Projections coaxial with the shaft of the photosensitive drum 41 in process cartridge 17 are inserted into guide grooves 23*c* in side plates 23*b*. Process cartridge 17 is guided by guide grooves 23*c* to a predetermined position. Parallel carrying plates 23*d* are interposed between side plates 23*b*, and extend from stand 23*a*. Support recesses 23*e* for supporting the shaft of resist roller 9 are formed in carrying plates 23*d*. Stand 23 has an opening 23*f* into which the first electrical equipment unit 26 is inserted from the direction indicated by arrow F.

Openings 23*g* are formed in side plates 23*b*. When the gear of the fixing device 5, the gear of the resist roller 9, drum gear integral with the photosensitive drum 4, etc. are connected to a plurality of gears 29 of drive unit 24, and are inserted into the openings 23*g*. The drive unit 24 supports gears 29, whose driving force is transmitted from main motor 3.

An optical scanning unit (not shown) integral with a scanner and a mirror is attached to the upper portion of frame 23 so as to cover it.

Drive unit 24 is composed of main motor 3, gears 29, frame 31 of the drive unit made of galvanized sheet metal, solenoid actuator 32, and connector 33 for supplying an electric current to the solenoid actuator 32. Main motor 3 is fixed to frame 31 of the drive unit and connected to gears 29, and supplies all the driving force. Gears 29 are engaged with metal shafts fixed by frame 31 of the drive unit. The solenoid actuator 32 intermittently drives resist roller 9 fixed to frame 31 of the drive unit.

The image forming apparatus can be miniaturized effectively since the gears, which are driving force transmitting members, are rotatably supported by frame 31 of the drive unit, since the gears are arranged on only one longitudinal side of the image carrier in the image forming apparatus.

Frame 31 of the drive unit is large enough to cover most of one side of the image forming apparatus. All gears, which are first driving force transmitting members, except for gears coaxial with driven members, such as the paper feed roller 8 and resist roller 9, which are second driving force transmitting members are attached to frame 31 of the drive unit.

Frame 31 of the drive unit is substantially the same height as side plates 23*b* of frame 23. An attaching portion 32*a* of frame 31 is fixed by a positioning member (not shown) to the outside of side plate 23*b* of frame 23, and placed on stand 23*a*. As indicated by arrow B, drive unit 24 is moved toward one side plate 23*b* so that it becomes parallel to this plate, whereby the gears of drive unit 24 engage with gears of the fixing device 5, resist roller 9, process cartridge 17, paper feed unit 25, etc.

Main motor 3, which is a driving source, and the gears, which are the first driving force transmitting members, are arranged on drive unit 24. There are also a pair of reduction gears 29*a*, another pair of reduction gears 29*b*, the latter of which cannot be seen because they are behind the side plate 23*b*. A few components are arranged on drive unit 24, even when an intermediate gear is included. Shafts for supporting the gears of the drive unit 24 are press-fitted into holes in frame 31 of the drive unit. Therefore, the distance between the shafts depends upon the accuracy with which the holes are formed in frame 31 of the drive unit. Since the holes are formed in a single frame 31 of the drive unit, they are formed with high accuracy and can be stably mass-produced.

In the present invention, frame 31 of the drive unit is grounded. The reason for this will be discussed below.

Figure 5:
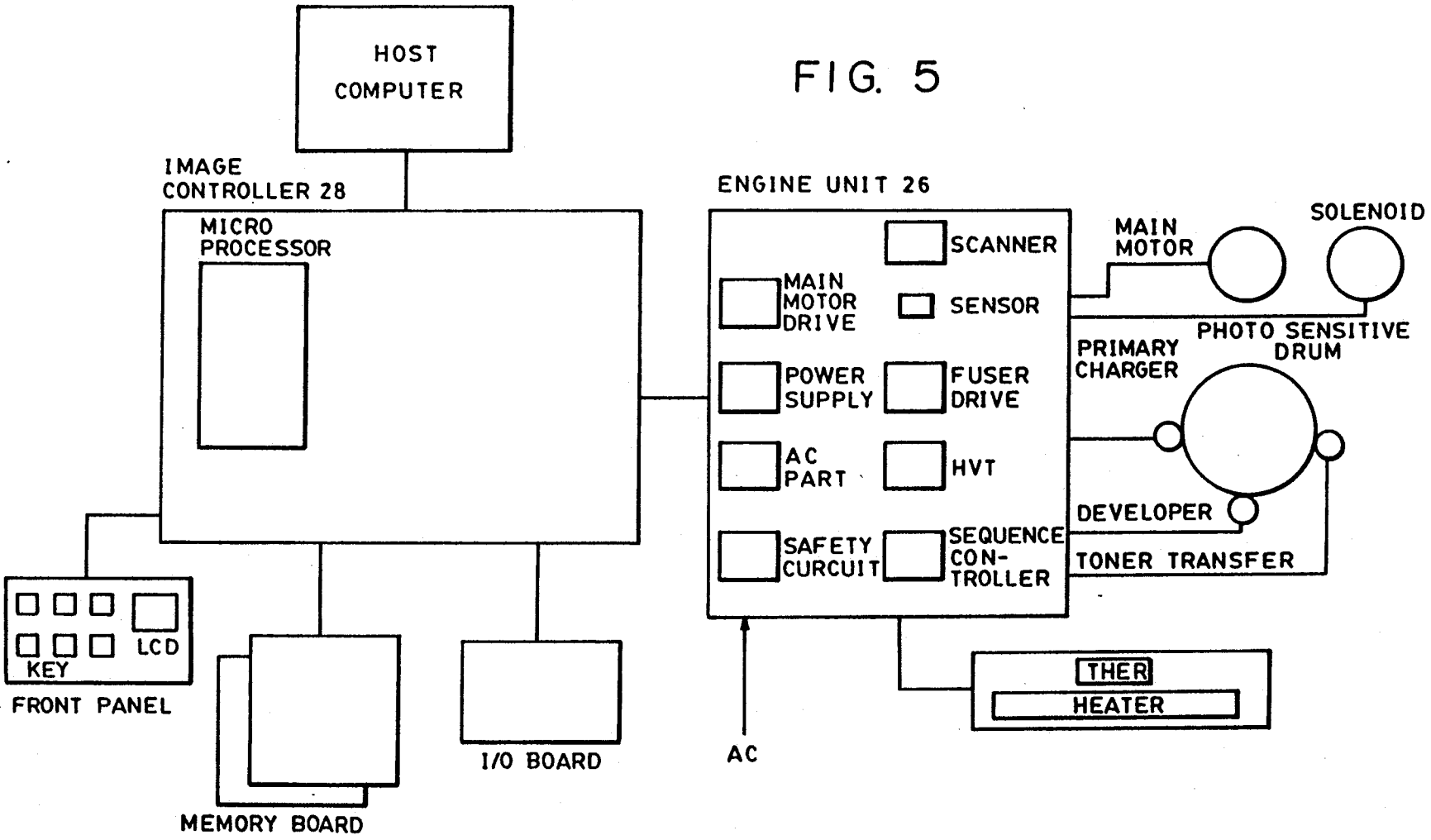
FIG. 5 is a view showing an image controller and an engine unit of the present invention.

As mentioned previously, the image forming apparatus of this invention has a first electrical equipment unit 26, which is the engine unit, and a second electrical equipment unit 28, which is the image controller (see FIG. 5). The first electrical equipment unit is covered with a grounded sheet, made of, for example, aluminum, so as to prevent radiation noise from being transmitted from this unit. However, radiation noise produced by the first electrical equipment unit 26 is transmitted to the second electrical equipment unit 28 through connector 38, which electrically connects the former unit to the latter unit. Therefore, the radiation noise is transmitted from the second electrical equipment unit 28. Frame 31 adjacent to the second electric unit 28 is grounded to prevent such noise from being transmitted. In other words, when frame 31 of the drive unit is grounded, the electric field which offsets the electric field formed by the second electrical equipment unit 28, is generated on the side of frame 31 opposite to the side where the second electrical equipment unit 28 is disposed.

Frame 31 of the drive unit serves not only as a shield from magnetism generated by the solenoid actuator 32, but also as a member for dissipating the heat generated by main motor 3. Because the gears are enclosed between frame 31 of the drive unit and side plate 23*b* of frame 23, it is possible to reduce noise caused by the engagement of the gears.

Paper feed unit 25 is inserted into the opening 23*f* from the direction indicated by D. It is made up of paper roller 8, gear 34 connected to roller 8 through clutch 35, clutch 35, solenoid actuator 12 for operating clutch 35, and frame 36 of paper feed unit 25, to which roller 8, gear 34, clutch 35, and actuator 12 are all attached. When paper feed unit 25 is inserted into opening 23*f*, gear 34 is positioned outside one side plate 23*b*, thus coming into engagement with the gear of drive unit 24.

The second electrical equipment unit 28 is an electrical equipment substrate to which an interface connector 37 and connector 38 are attached. Connector 38 penetrates frame 31 of the drive unit and frame 23, and is connected to the first electrical equipment unit 26 in the image forming apparatus.

Frame 31 of the drive unit intercepts radiation magnetism generated inside the image forming apparatus, and satisfactorily muffles noise produced by the drive unit itself. The second electrical equipment unit 28, through which an extremely weak high-frequency current flows, is disposed outside frame 31 of the drive unit so that unit 28 is near frame 31. By virtue of the foregoing arrangement, the image forming apparatus is prevented from transmitting noise it produces. Frame 31 of the drive unit, of course, is grounded through wiring (not shown).

Various components of the image forming apparatus are constructed as described above. These components are assembled in the following order. First, resist roller 9 is inserted into support recesses 23*e* in frame 23, and then fixing device 5 is attached to frame 23. Drive unit 24 is attached to frame 23; second electrical equipment unit 28 is attached to the outside of drive unit 24; and paper feed unit 25 is attached to frame 23. During the above operation, the gears of drive unit 24, which are first driving force transmitting members, are connected to fixing device 5, paper feed roller 8, resist roller 9 and other components. The first electrical equipment unit 26 is inserted into opening 23*f* of frame 23. As mentioned previously, the optical scanning unit (not shown) integral with the scanner and the mirror is attached to the upper portions of side plates 23*b*. The projections of process cartridge 17 are inserted into guide grooves 23*c*. Finally, external frame I is placed over and covers all components mentioned above.

In this manner, gears 29 of drive unit 24, which are the first driving force transmitting members, are covered with external frame 1, side plates 23*b* and frame 31 of the drive unit. Noise produced by the first electrical equipment unit 26 can be effectively muffled since external frame 1, second electrical equipment unit 28 and frame 31 of the drive unit, all of which serve as sound barriers and which have wide areas facing the outside. The transmissibility and the wear resistance of gears 29 improve, thus increasing the life of the image forming apparatus, improving image quality, and reducing vibrations and noise. Frame 31 of the drive unit, to which the first driving force transmitting members are attached, serves not only as a shield from magnetism but also as a member for dissipating heat, thereby decreasing the cost of the image forming apparatus. The second electrical equipment unit 28 is disposed outside frame 31 of the drive unit to satisfactorily muffle noise. Such an image forming apparatus can be stably mass-produced.

Figure 2:
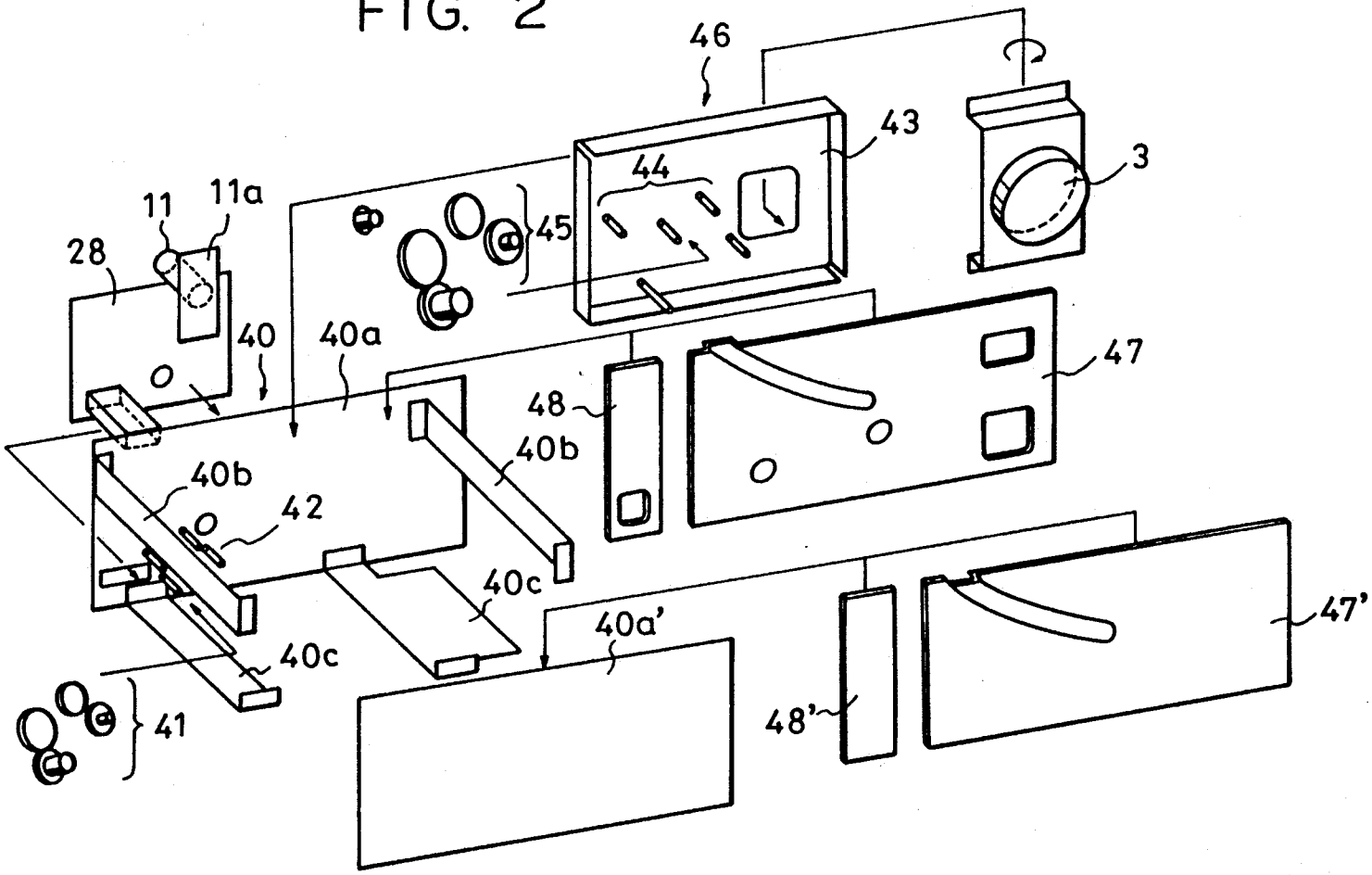
FIG. 2 is an exploded perspective view showing a second embodiment of an image forming apparatus in accordance with, the present invention.
Figure 3:
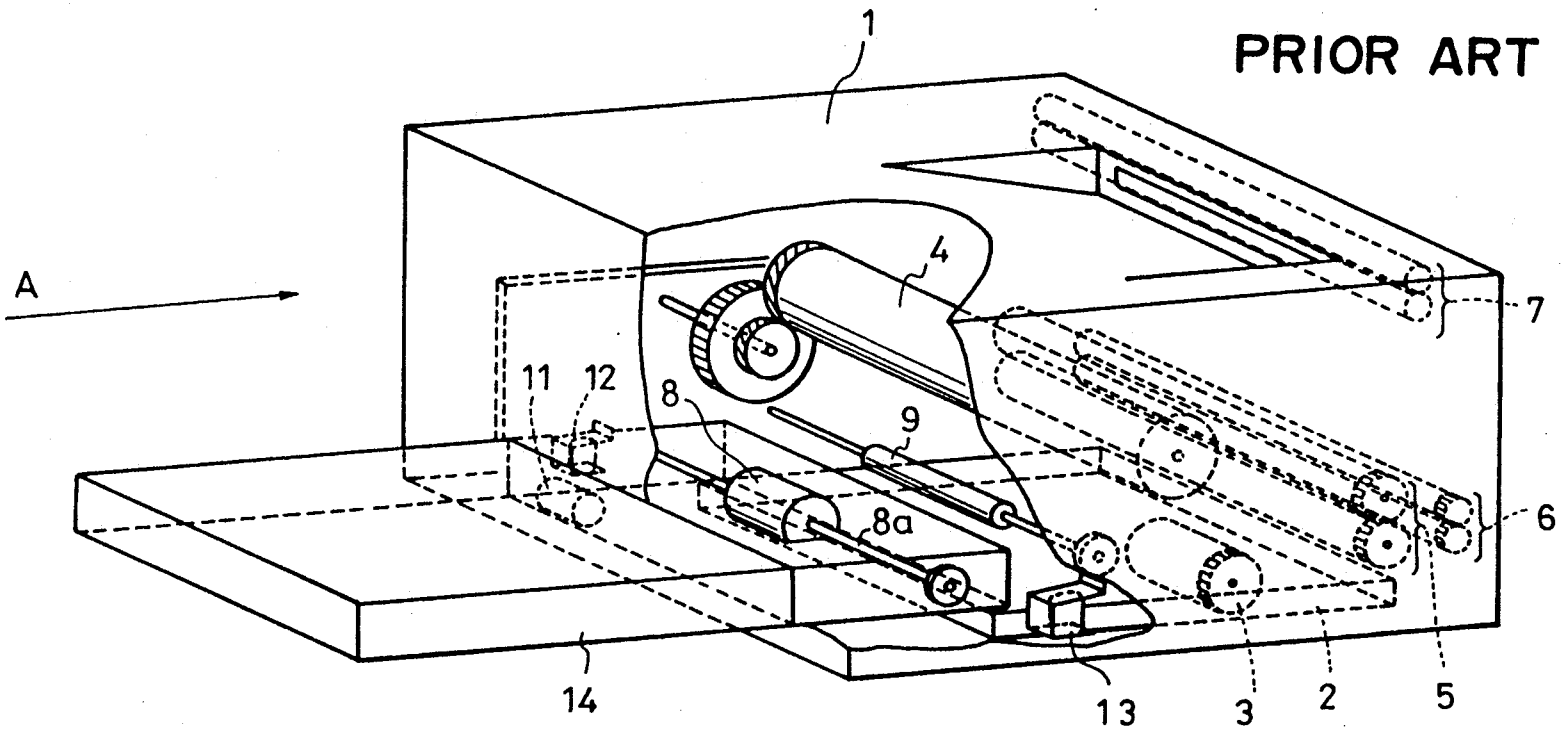
FIG. 3 PRIOR ART
FIG. 3 is a perspective view showing a conventional image forming apparatus.

A second embodiment of this invention will be described below with reference to FIG. 2, which is an exploded perspective view illustrating the structure of an image forming apparatus in accordance with this invention. In the second embodiment, a laser beam printer is used as an example, and a frame constituting the framework of the image forming apparatus is made of sheet metal. The explanations of a fixing device, an optical scanning unit, electrical equipment units and other components are omitted in this embodiment.

Frame side plate 40*a*, which serves as the frame of a drive unit, is joined to another frame side plate 40*a* so as to construct a frame generally denoted by numeral 40. The two side plates 40*a* and 40*b* are connected to each other by upper and lower stays 40*b* and 40*c* with the aid of small screws. Paper feed motor 11 and main motor 3 are used in this embodiment for operating other components. Paper feed motor 11 is secured by small screws to one frame side plate 40*a* with the aid of attaching plate 11*a*. A plurality of gears 41 are attached to a plurality of metal shafts 42 fixed by frame side plate 40*a*. Gears 41 are used for reducing the driving force of paper feed motor 11 and transmitting it to a paper feed roller and a carrier roller. Main motor 3 is attached to frame 43 of a drive unit. A plurality of metal shafts 44 are fixed by frame 43 of the drive unit, which serves as a supporting member and is made of, for example, galvanized sheet metal. A plurality of gears 45 driven by main motor 3 are rotatably attached to the metal shafts 44 so that they form a gear bank.

Main motor 3 and paper feed motor 11, both driving sources, and gears 41 and 45, both driving force transmitting members, are attached directly or through frame 43 of the drive unit to frame side plate 40*a*, which is on one side of the image forming apparatus. Gears 45 attached to frame 43 of the drive unit are surrounded by the four sides of frame 43 which are bent in the shape of a box. Frame 43 of the drive unit is electrically conductive to a frame ground. Molded inner covers 47, 47', 48 and 48', all of which are used for guiding and supporting a process cartridge, are disposed inside the frame side pates 40*a* and 40*a'*. Because of such a structure, gears 45 and gears 41 on the frame side plate 40*a* are enclosed inside the inner covers.

The above-mentioned components are assembled in the following manner. Gears 41 are attached beforehand to frame side plate 40*a*. Frame side plate 40*a* serves as a drive unit for a paper feed roller and a resist roller and part of the framework of the image forming apparatus. Drive unit 46, composed of main motor 3, gears 45, and frame 43 of the drive unit, is attached to the inside of frame side plate 40*a*. Electrical equipment unit 28 is attached to the outside of frame side plate 40*a*. As mentioned previously, the molded inner covers 47, 47', 48 and 48' are attached to the insides of the frame side plates 40*a* and 40*a* '. Inner cover 47 covers drive unit 46 and gears 41 used for the resist and paper feed rollers.

Also in this embodiment, two types of driving force transmitting members, through which a driving force is transmitted from two types of motors 3 and 11, are gears engaged with shafts fitted in holes in a single frame made of sheet metal. The distance between gear shafts is more accurate than in other structures. Because of the above structure, the transmissibility of the gears improve, thus increasing the life of the image forming apparatus, improving image quality, and reducing vibrations and noise. The heat of the motors can be effectively dissipated as well as muffling noise and prevent such heat from increasing.

In the same manner as in the first embodiment, the electrical equipment unit 28, through which an extremely weak high-frequency current flows, is attached to the outside of frame side plate 40*a* so that unit 28 is near plate 40*a*. The connector of the unit 28 penetrates side plate 40*a* and is connected to another electrical equipment unit (not shown) in the image forming apparatus. Thus, noise is satisfactorily muffled.

By virtue of the foregoing structure, because the driving force transmitting members and driving sources are supported by a single member made of sheet metal, the distance between gear shafts is more accurate than in other structures. The present invention provides advantages, such as high image quality, high transmissibility of the gears, low noise and vibration, and increased life of the image forming apparatus.

A member for supporting the gears and the driving force sources is made of sheet metal and grounded. It is used as a shield and a plate for dissipating heat, thereby preventing the transmission of noise and providing a cooling effect. The image forming apparatus of this invention can be manufactured at low cost.

Since the driving force transmitting members are enclosed in a substantially airtight space, noise produced by such members is muffled and prevented from being transmitted to the outside. It is therefor not necessary to take additional countermeasures for muffling noise, and the image forming apparatus can be operated quietly.

A process cartridge and driving force transmitting members for transmitting force to carrying means, both image forming means, are formed into units which are disposed only on one side of the image forming apparatus. Such an arrangement reduces the number of components. It is therefore possible to first assemble these units separately from other components and then assemble the other components, thereby reducing the number of steps of assembling the image forming apparatus.

Grounded sheet metal is interposed between the first and second electrical equipment units, and a plurality of gears are supported on this sheet metal. Thus, radiation noise can be reduced and space inside the image forming apparatus conserved.

The present invention is not limited to the embodiments described above, and various modifications may be made within the same technological concept as that described herein.

What is claimed is:

1. An image forming apparatus comprising:

image forming means for forming an image onto a recording material;

a driving source for driving said image forming means;

a plurality of drive force transmitting members for transmitting a drive force from said driving source to said image forming means;

a plurality of electrical equipment units for controlling said image forming means, each of said plurality of electrical equipment units being disposed on a substrate; and a metal plate interposed between at least two of said plurality of electrical equipment units, wherein said metal plate is grounded and is operable to support said plurality of drive force transmitting members.

2. An image forming apparatus according to claim 1, wherein said plurality of electrical equipment units comprise an engine unit having at least one power supply and one transformer, and and image controller unit for converting an image code transmitted from a computer into a dot image.

3. An image forming apparatus according to claim 1, wherein said image forming means includes an image carrier, charging means for charging said image carrier, developing means for developing a latent image formed on said image carrier, transferring means for transferring a developed image onto the recording material, and cleaning means for cleaning residue on said image carrier.

4. A image forming apparatus according to claim 3, wherein said plurality of driving force transmitting members are first gears.

5. An image forming apparatus according to claim 4, further comprising second gears which are not supported by said metal plate, and wherein said first gears and said second gears are arranged on a longitudinal side of said image carrier.

6. An image forming apparatus according to claim 1, wherein said plurality of driving force transmitting members are gears, and wherein said metal plate supports rotating shafts of said gears.

* * * * *